United States Patent [19]

Hewitt

[11] 4,148,158

[45] Apr. 10, 1979

[54] LAWN MOWER BLADE GRINDER

[76] Inventor: John J. H. Hewitt, 99, Aldwych, London WC2B 4JY, England

[21] Appl. No.: 796,139

[22] Filed: May 12, 1977

[51] Int. Cl.[2] ..... B24B 5/36

[52] U.S. Cl. ..... 51/48 HE

[58] Field of Search ..... 51/48 HE, 50 R, 165.78, 51/165.86, 218 T

[56] References Cited

U.S. PATENT DOCUMENTS

| | | | |
|---|---|---|---|
| 1,967,118 | 7/1934 | Glasgow | 51/48 HE |
| 2,279,798 | 4/1942 | Shelburne | 51/48 HE X |
| 2,314,945 | 3/1943 | Maynard | 51/48 HE |
| 2,438,835 | 3/1948 | Weimar | 51/165.86 |
| 2,469,077 | 5/1949 | Rickenmann | 51/165.78 X |
| 2,777,258 | 1/1957 | Avra | 51/48 HE |
| 2,780,034 | 2/1957 | Turner | 51/48 HE |
| 3,045,398 | 7/1962 | McEwan | 51/48 HE |

*Primary Examiner*—Gary L. Smith

*Attorney, Agent, or Firm*—Limbach, Limbach & Sutton

[57] ABSTRACT

A device is disclosed for grinding the blades of a lawn mower unit without disassembling the lawn mower blade reel from its supporting structure. The device is capable of both single blade grinding and spin grinding and is adjustable so that virtually any relief angle can be cut in the lawn mower blade edge.

2 Claims, 13 Drawing Figures

LAWN MOWER BLADE GRINDER

BACKGROUND OF THE INVENTION

Heretofore, the grinding of a lawn mower reel has been a tedious and time consuming project for a number of reasons. There has never been a device which was capable of both single blade grinding and spin grinding of the entire lawn mower reel, without removing it from its supporting assembly. In prior art devices, only single blade grinding of the mower reel could take place, either by removing the reel from its supporting assembly or by mounting the assembly complete with reel in the grinding machine.

Alternatively, another prior art machine provides for spin grinding of the reel but only if the reel is removed from its supporting assembly. All single blade grinding, whether the reel is removed from its frame for the purpose or not, produces a result which is rarely accurate enough to give satisfactory reel/cutter bar engagement. It is necessary for proper cutting to provide tolerances in the order of 0.001 of an inch and slight misalignment can cause poor cutting performance and increased wear on both the mower reel and cutting bar.

Prior art machines have provided for single blade grinding and spin grinding although no single machine has to date been perfected which could perform both operations, without removing the reel from its assembly. For example, U.S. Pat. No. 2,279,798 to Shelburne discloses a device capable of single blade grinding while U.S. Pat. No. 2,314,945 to Maynard, et al. discloses a device which can only spin grind a mower reel. As stated previously, the machines disclosed by Shelburne and Maynard require disassembly of the lawn mower structure for the grinding machines disclosed therein are capable of only accepting the reel portion of the lawn mower.

A device which can both single blade grind and spin grind a lawn mower reel without removing it from its frame provides for a degree of flexibility far superior to any sharpening technique available before the present invention. Each blade of a lawn mower reel must not only be spun ground but also cut to provide a relief angle on the surface of the blade which contacts the cutting bar. In prior art grinding operations, once this was accomplished, the reel was removed from the grinding machine and attached to the lawn mower assembly containing a cutting bar. Lapping paste would be placed upon the reel and the reel revolved backwards mechanically so as to obtain a proper cutting relationship between the individual cutting blades of the reel and the cutting bar. Alternatively, if the reel had been single blade ground while still mounted in its frame, the mower assembly was removed from the grinding machine, the cutting bar was attached, and the same lapping operation performed.

In spin grinding devices, such as those disclosed by Maynard et al., although the necessity for lapping is diminished by the spin grinding cycle, there was no way in which such a device could provide the necessary relief angle on the individual cutting blades. Some lapping may nevertheless be necessary even after spin grinding with such a machine for, as was stated previously, the cutting reel must be removed from the lawn mower assembly in order to fit within the spin grinding machine and reassembling the lawn mower structure would more times than not result in some misalignment which may require a lapping operation to get proper fit between the lawn mower reel and cutting bar.

In the device of the present invention, a relief angle can be cut within each cutting blade while a spin grinding operation can further be carried out in order to eliminate the need for lapping. There are also no reassembly tolerance problems for the entire lawn mower assembly is never disassembled. Alternatively, the spin grinding operation can be carried out firstly, followed by the single blade grinding operation to produce the relevant relief angle to each individual blade.

SUMMARY OF THE INVENTION

It is therefore an object of the present invention to eliminate all of the above-recited disadvantages in prior art devices for grinding and sharpening lawn mower blades.

It is a further object of the present invention to provide a device capable of grinding and sharpening lawn mower blade reels without removing said reels from the entire lawn mower assembly.

It is yet another object of the present invention to provide a machine which is capable of both single blade grinding and spin grinding of lawn mower blade reels.

It is a further object of the present invention to provide a device which will automatically traverse the entire length of a lawn mower blade reel and spin grind said reel automatically.

It remains yet another object of the present invention to preset the amount of lawn mower blade which is removed in each grinding pass of the grinding wheel of the present invention.

It is also an object of the present invention to provide a device which is capable of grinding virtually any desired relief angle in the surface of blades of lawn mower reels.

Further objects of the invention are set forth in the following specification which describes a preferred form of construction of the machine, by way of example, as illustrated by the accompany drawings, in which.

Figure 1:
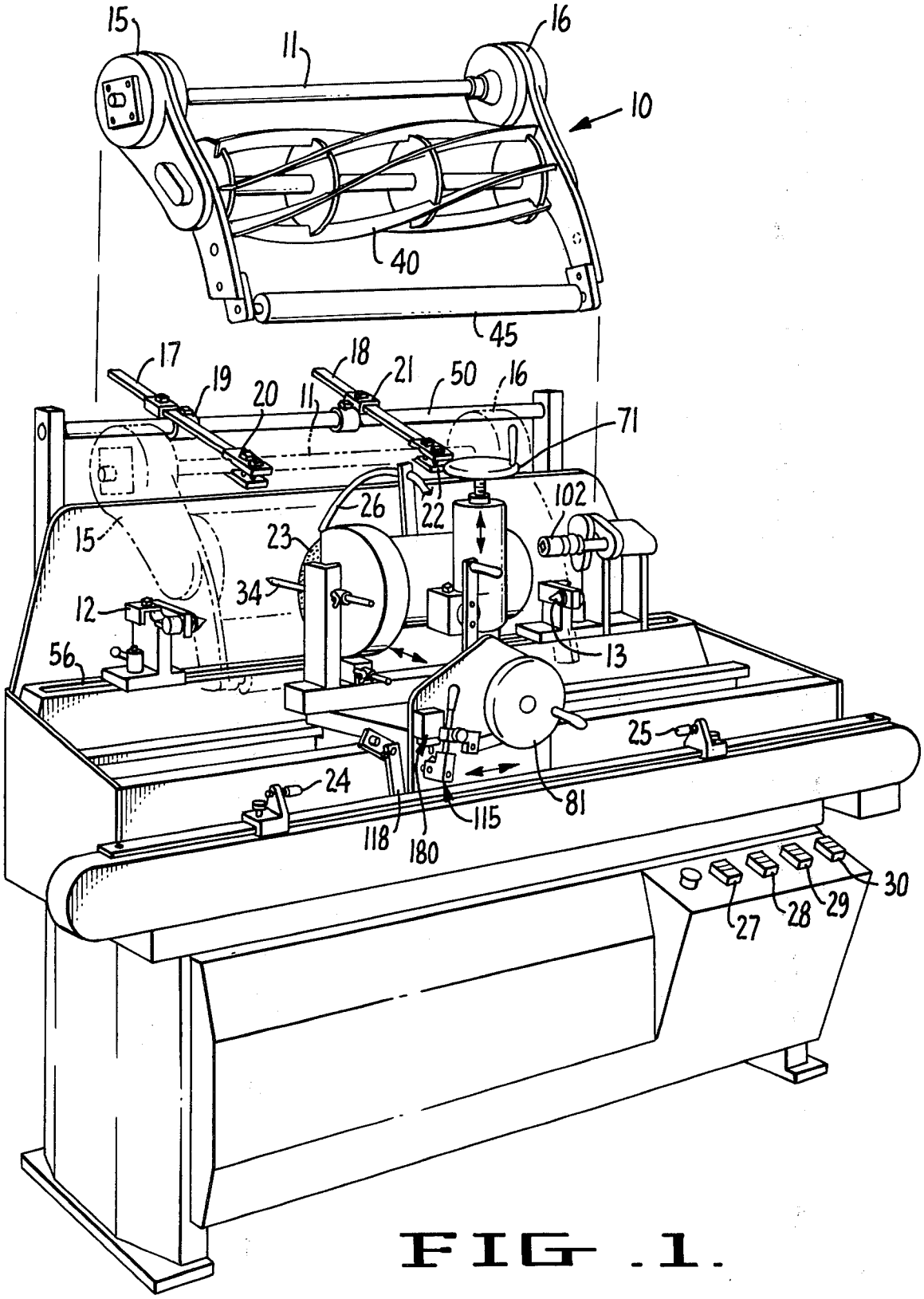
FIG. 1 is a perspective view of the device of the present invention.

Referring to FIG. 1, reel assembly 10 is comprised of various elements such as tie bar 11 connecting left and right reel support members 15, 16, reel 40 and roller 45.

Figure 2:
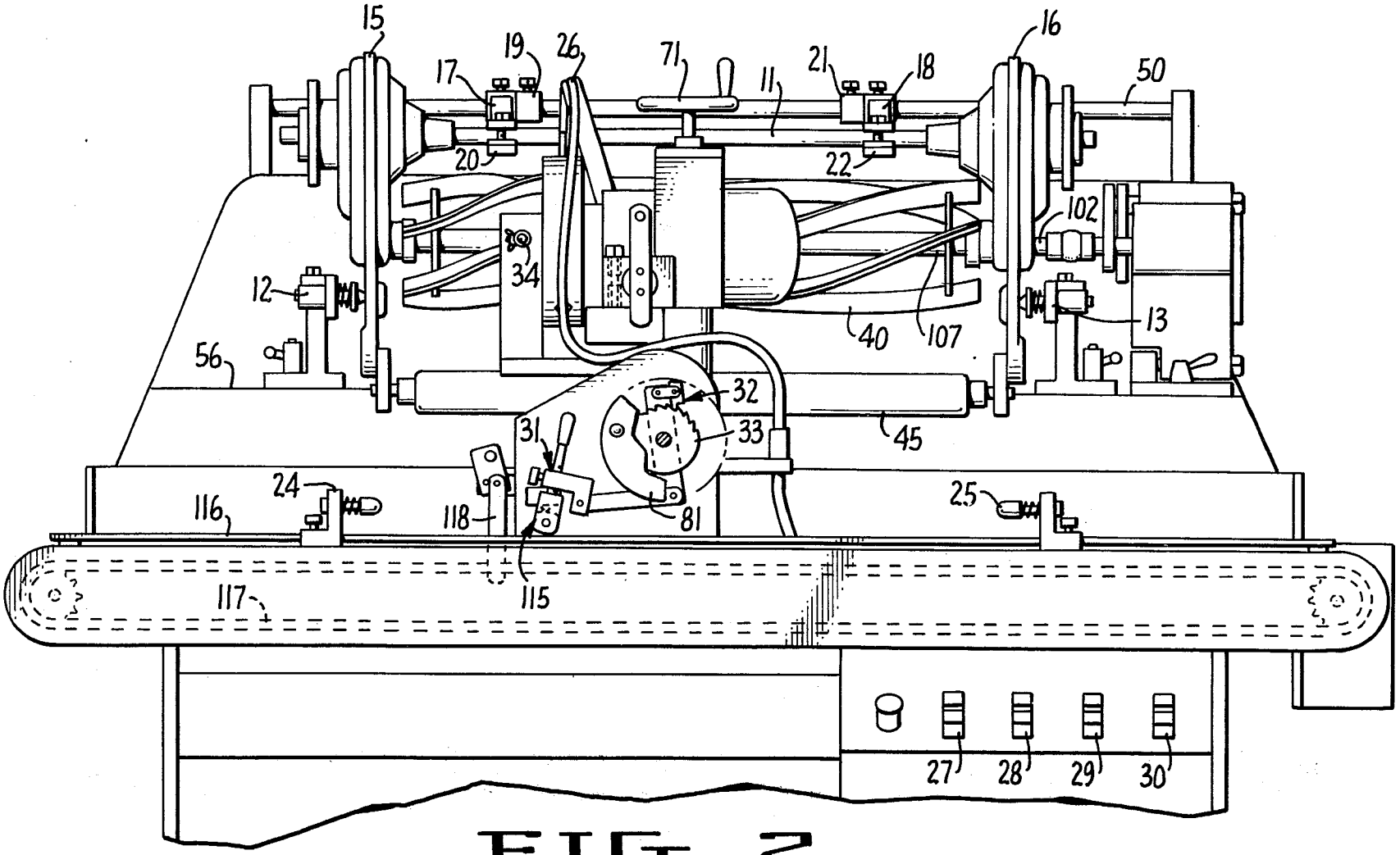
FIG. 2 is a front view of the device shown in FIG. 1.
Figure 3:
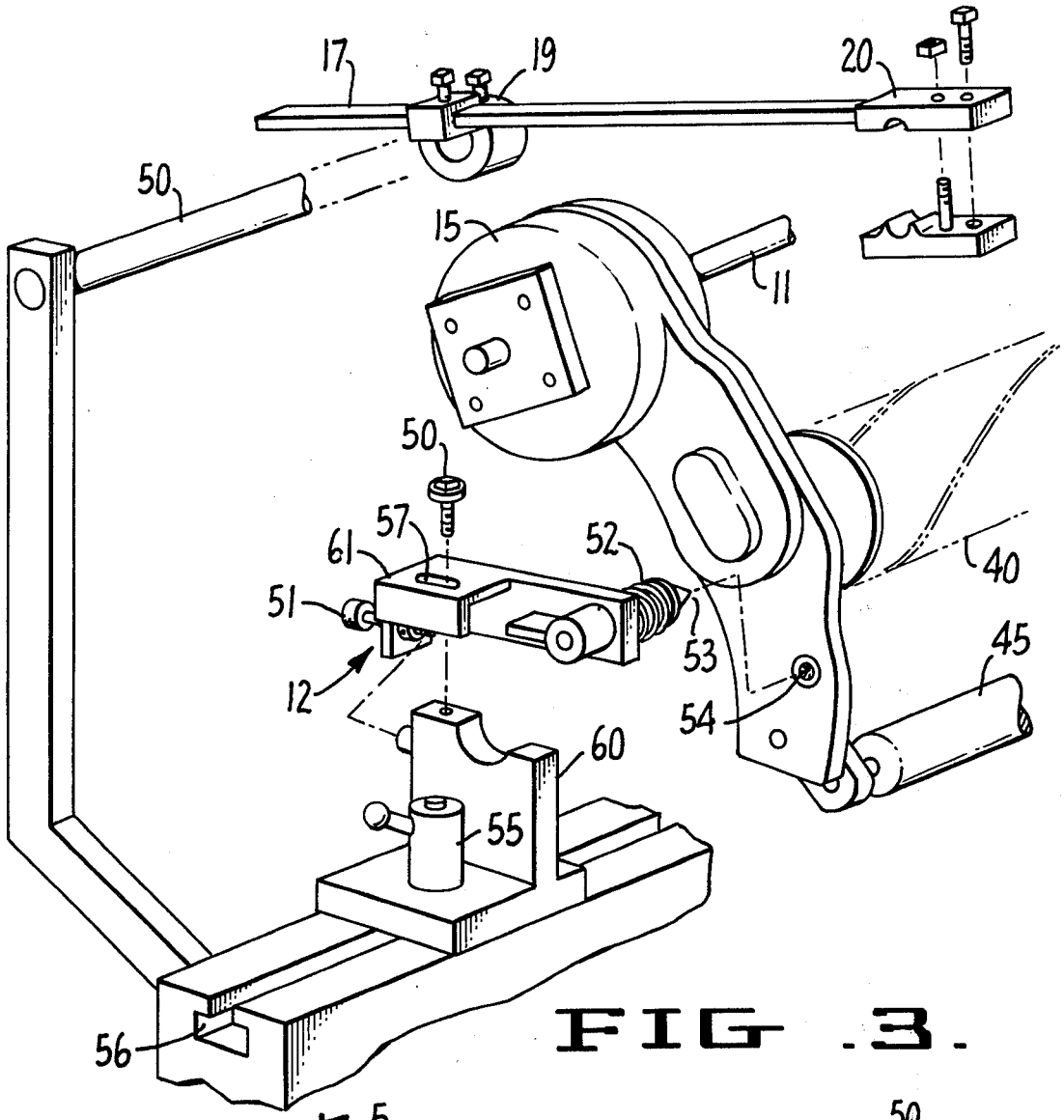
FIG. 3 is an exploded view of the means to securedly attach the lawn mower reel and its supporting structure to the device of the present invention.
Figure 4:
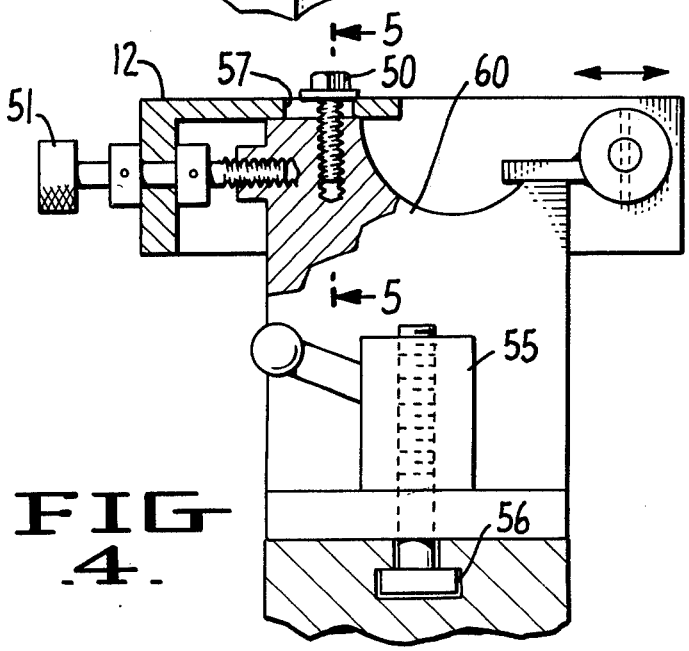
FIG. 4 is an end view, partially in section, of the tailstock used to secure the lawn mower assembly shown in FIG. 3.
Figure 5:
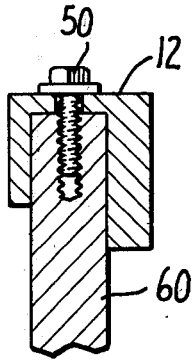
FIG. 5 is a sectional view taken along line 5—5 of FIG. 4.
Figure 6:
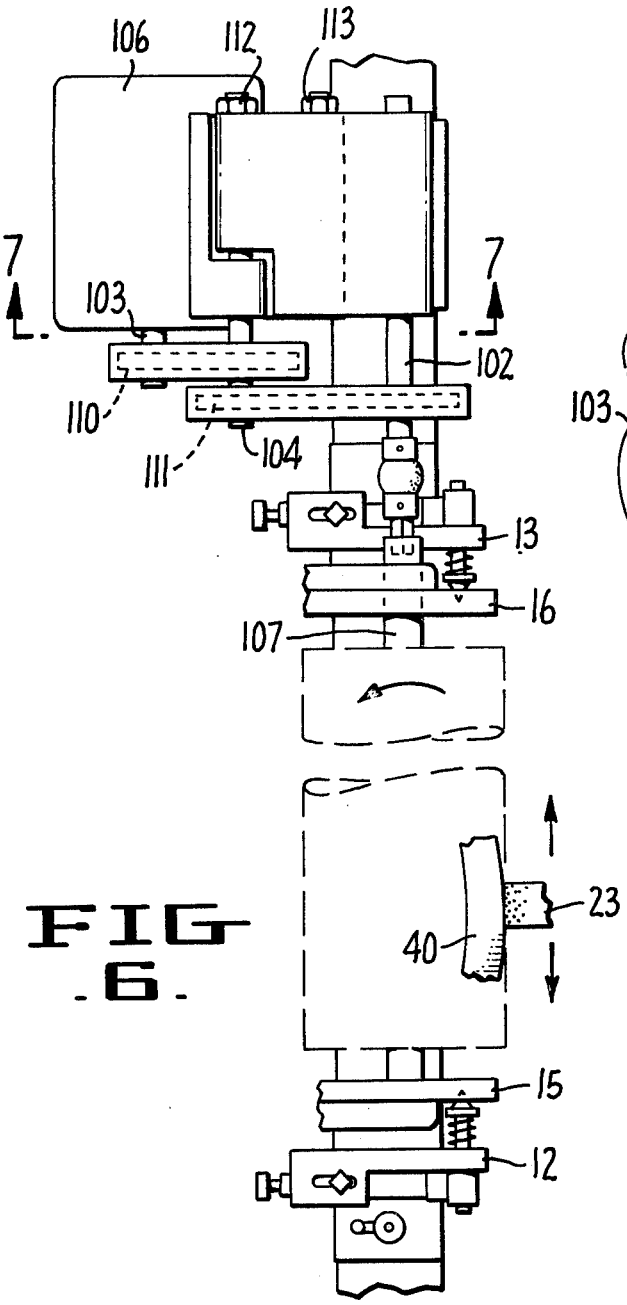
FIG. 6 is a top view of a lawn mower reel and connecting structure during spin grinding employing the device of the present invention.
Figure 8:
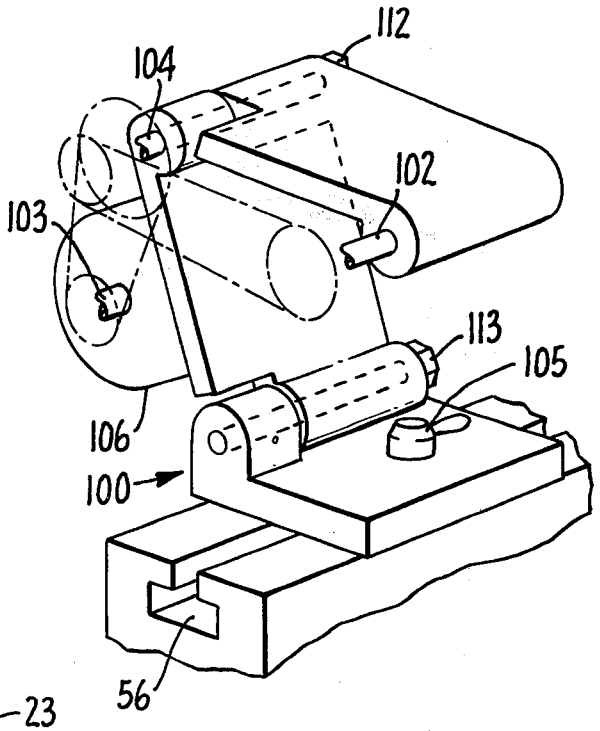
FIG. 8 is a perspective view of that part of the present invention which rotates the lawn mower reel for the spin grinding operation.
Figure 7:
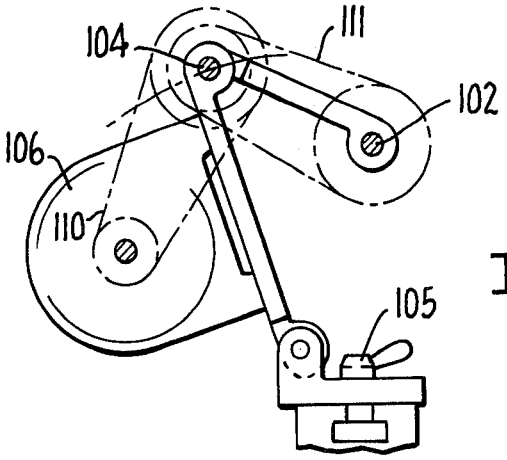
FIG. 7 is a side sectional view taken along line 7—7 of FIG. 6.

Lawn mower assembly 10 is placed within the device of the present invention as shown by dotted lines in FIG. 1 and in FIG. 2. This assembly is secured to the grinding device by means of bars 17, 18 and clamps 19, 20, 21 and 22. This securing means is completely adjustable and attaches tie bar 11 to horizontal securing bar 50 as shown in FIG. 1. Lawn mower assembly 10 is further secured to the device of the present invention by means of tailstock members 12 and 13. These elements can be more fully appreciated by viewing FIGS. 3, 4 and 5 which depict exploded and sectional views of lefthand assembly 12. The tailstocks are mounted on channel 56 such that by loosening clamping means 55, tailstock bases 60 can be traversed in order to accommodate lawn mower assemblies of various widths. Male tailstock member 53 is tapered to any desirable angle, such as an angle of approximately 60 degrees, for engagement in opening 54 which is pre-existing in virtually every lawn mower assembly structure. In order to aid alignment, bolt 50 can be loosened and entire element 12 (FIG. 4) can be moved laterally with respect to either base portion 60. Once male support member 53, biased by spring 52, is aligned with opening 54, bolt 50 can be retightened within channel 57. For fine adjustments, bolt 50 can be loosened and screw adjustment 51, channeled through plate 61, can be turned in order to move 61 anywhere within the distance allowed by the sidewalls of channel 57.

Single Blade Grinding Mode

Figure 11:
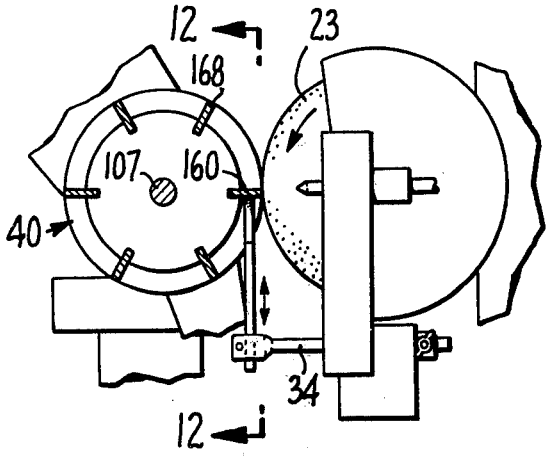
FIG. 11 is a side sectional view showing engagement of the grinding means and lawn mower reel during individual blade grinding.
Figure 12:
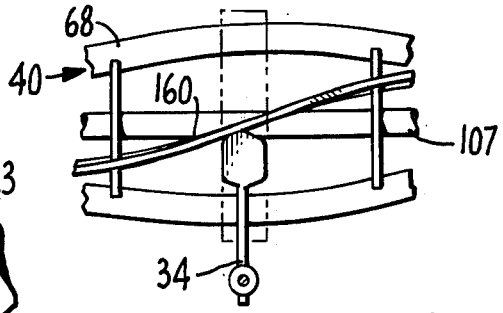
FIG. 12 is an enlarged detailed view of engagement between the lawn mower reel and an adjustable finger guide means used to maintain contact between the grinding wheel and individual blade.
Figure 13:
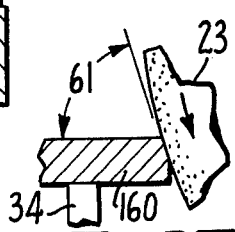
FIG. 13 is a detailed view of FIG. 12 which shown fabrication of a relief angle within a lawn mower blade by use of the finger guide means and grinding wheel.

With reference to single blade grinding, particular attention is directed toward FIGS. 1, 11, 12 and 13. After lawn mower reel assembly 10 has been inserted and the above-described securing means adjusted and set, attention can be drawn to the grinding of individual reel blades. Generally, grinding wheel 23 is brought into intimate contact with mower reel 40 flush to the face of individual blade 160 (FIG. 11). Without support finger guide means 34, such contact would cause reel 40 to spin in a clockwise directly and individual blade grinding would be impossible. Therefore, support finger 34 is employed which supports that face of mower blade 160 which counters the directional inertia placed on the blade by grinding wheel 23. In FIG. 11, the support finger 34 is shown on the bottom face of blade 160 for this counters the tendency of reel 40 to spin in a clockwise direction. Finger 34 is vertically adjustable so that blade 160 can be ground at virtually any relief angle. In FIG. 11, no relief angle is depicted as the tangential points of contact between grinding wheel 23 and reel 40 are substantially parallel. However, as can be seen by viewing FIG. 13, a relief angle 61 can be established in blade 160 merely by adjusting the height of support finger 34.

Figure 9:
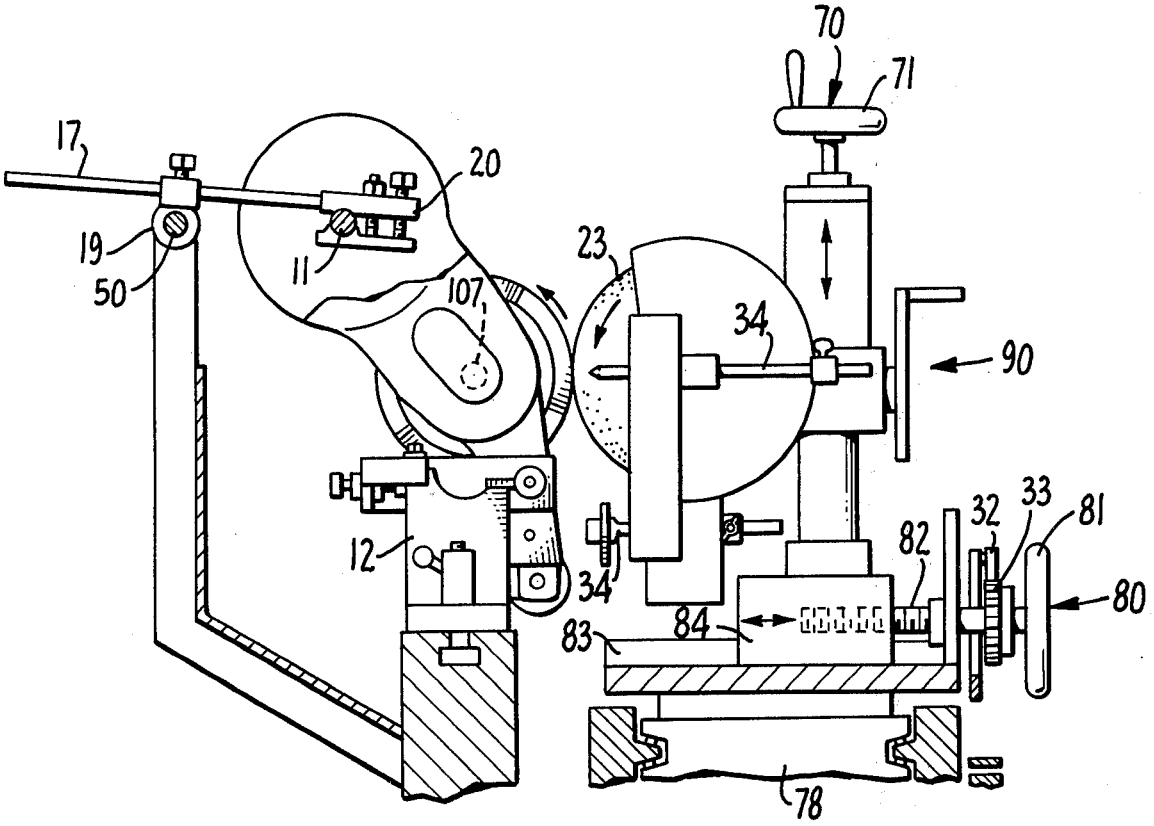
FIG. 9 is a side sectional view of the device of the present invention showing engagement of the lawn mower reel and grinding wheel during the spin grinding operation.

The relative contact between grinding wheel 23 and individual mower blade 160 can further be modified by adjustment means generally denominated as 70 and 80 in FIG. 9. In order to accommodate mower reels and/or mower assemblies of various sizes, it is necessary to provide for an adjustable grinding means so that the relationship as shown in FIG. 11 can be achieved. Element 70, which is a vertical height adjustment, comprises a threaded joint which moves the entire grinder assembly up or down in response to turning handle 71. Horizontal movement of the assembly can be accomplished by structure 80 which constitutes handle 81 which moves the assembly by means of threaded screw 82 along slideway 83. At a later point in this specification, it will be described how this horizontal adjustment can be done automatically.

Although not depicted in any drawing, the entire grinding wheel assembly can be rotated 90 degrees for grinding cutter bars when desired. Handle 90 (FIG. 9) can be turned from its vertical position as shown to a horizontal alignment, after releasing the locking device, which frees the grinding wheel assembly for a 90 degree rotation.

Once support finger 34 and grinding wheel 23 are properly aligned with respect to reel blade 160, the entire grinding wheel assembly is moved from one extremity of the blade to its opposite extremity. The entire assembly moves along channel 78 (FIG. 9) causing grinding wheel 23 to act upon the entire length of blade 160. If, for example, blade 160 is ground first at its right-hand end, the operator would move the entire assembly down channel 78 towards the lefthand part of the reel. The grinding wheel and supporting finger 34 is then permitted to travel beyond the lefthand extremity of the reel, so that the reel can be revolved in either a clockwise or counterclockwise direction to bring the next adjacent blade into approximately the same relative position as the blade previously ground. At this point, the grinding assembly is moved towards the right causing support finger 34 to engage the next reel blade 168 (FIG. 11) and this blade is in turn ground just as blade 160 described above. By moving the grinding assembly back and forth over the mower reel, each individual reel blade can thus be contacted alternately with grinding wheel 23 for single blade grinding.

As described above, a specific relief angle can also be placed upon any blade during the single blade grinding mode. By adjusting the height of grinding wheel 23, with respect to the center of mower reel 40 or by adjusting the height of support finger 34, the grinding wheel can be caused to contact the reel blades at virtually any predetermined angle. The point of contact can be most advantageously appreciated by viewing FIG. 13, discussed above.

Spin Grinding Mode

With regard to spin grinding, attention is particularly drawn to FIGS. 2 and 6–10. Before spin grinding can take place, support finger 34 is withdrawn from contact with mower reel 40 (see FIG. 9). During spin grinding, spin grinding workhead 100 is functionally attached to reel 40 via reel shaft 107. The workhead comprises a motor and housing 106 being ultimately connected to reel shaft 107 via intermediate shafts 103, 104 and 102 by means of belts 110, 111. This configuration was selected so that match-up of shaft 102 with reel shaft 107 can be accomplished regardless of the height of various reels to be ground by merely loosening bolts 112 and 113 and lining up shaft 102 with new reel shaft 107. The spin grinding workhead can be disengaged from the reel shaft by loosening bolt 105 and merely withdrawing the extremity of shaft 102 from its mating extremity of shaft 107 by sliding spin grinding workhead 100 along channel 56. This would be done during single blade grinding described above.

During spin grinding, the spin grinding workhead is designed to rotate the reel with respect to the grinding element such as shown in FIG. 9. For example, if the grinding element is rotating in a counterclockwise direction, the spin grinding workhead is configured to cause the lawn mower reel to spin also in a counterclockwise direction. The lawn mower reel can be ground in an automatic mode which can be appreciated by viewing FIG. 2. Once the width of reel 40 is determined, stops 24 and 25 are set upon channel 116 which defines the outermost path of travel of grinding wheel 23. If, for example, the grinding wheel assembly is traveling from left to right in FIG. 2, stop 25 will engage lever 115 which in turn activates microswitch 180 at the preselected grinding position of reel 40 as determined by the selection of the position of stop 25. Lever arm 118 is functionally attached to chain drive 117 which automatically pulls the grinder assembly along channel 116. When lever 115 contacts either stop 24 or 25 at the extreme grinding position of the reel, the microswitch flips position and causes the chain driving motor to change direction; thus changing the direction of the grinding wheel assembly within channel 116. Simultaneously, lever 115 causes automatic infeed pawl 32 to advance ratchet wheel 33 which thus radially moves grinding wheel 23 towards the center of reel 40. For example, ratchet wheel 33 can be configured to possess 45 teeth, each tooth representing 0.001 inches of feed. Thus, if the device of the present invention is allowed to continue automatic operation until 20 teeth have been engaged in response to lever 115, 0.020 inches of reel blade would be ground resulting in a total decrease in outer dimension of said reel by 0.040 inches. As can be appreciated, the automatic infeed pawl 32 can be configured to skip one or more teeth 33 during each actuation by lever 115 when it engages stop 24, by moving connecting bracket 81 further up lever 115. This then allows for a greater amount of reel blade to be ground during each pass of grinding wheel 23.

During either single blade grinding or spin grinding, it is at times advantageous to supply a cooling fluid, such as water, through hose 26. Although not critical to the operation of the present invention, the device depicted herein can possess push buttons 27, 28, 29 and 30 which are used to operate the grinding wheel motor, chain 117 which powers the automatic traverse system, the spin grinding workhead and the coolant supply, respectively.

Figure 10:
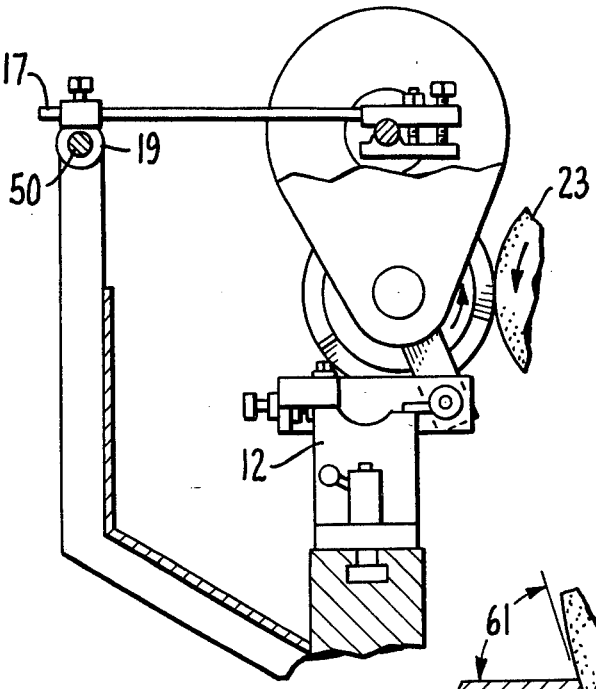
FIG. 10 is a side sectional view showing the supporting structure for the lawn mower reel assembly during grinding.

As stated previously, the device of the present invention is capable of accepting lawn mower reel assemblies of various configurations. FIG. 10 shows the side view of such an assembly which is different from others shown in FIG. 9 for example. It should be noted that by merely adjusting support bar 17, the new lawn mower reel assembly can be secured for grinding.

The above-described device of the present invention is particularly advantageous when one considers that a complete grinding operation of a lawn mower reel should entail spin grinding and single blade grinding or their equivalents. A lawn mower reel should be spun ground or more tediously lapped in conjunction with a cutter bar in order to prevent high spots on the cutting blades from binding up against the cutter bar. As stated above, this lapping operation is eliminated by use of spin grinding which assures the absence of any high spots on any of the blades of the lawn mower reel. Next, once the spin grinding is completed, each blade should be separately ground to provide the necessary relief angle. Generally, the lands or convex surface of the individual reel blades should constitute approximately one-third thickness of the blade with the relief angle taking up the additional two-thirds of said thickness. This greatly facilitates the grass cutting operation and thus should be accomplished in any thorough blade grinding operation. By practicing the present invention, the relief angle can be cut into the individual reel blades, and the entire radial extremities of the reel can be spun ground, without ever disturbing the mower assembly as described above.

What is claimed is:

1. A device for grinding the blades of a lawn mower reel without disassembling the lawn mower blade reel from its supporting structure and which is capable of both single blade grinding and spin grinding of said reel comprising:

a. bar and clamp means connecting the device to a tie bar of the supporting structure and a pair of tailstocks adapted to engage pre-existing holes within said supporting structure;

b. grinding means assembly which is vertically and horizontally adjustable to accommodate lawn mower assemblies of varying sizes and which is slidably attached to a channel in said device adapted to traverse the entire longitudinal blade reel and being further radially adjustable to contact reels of variable radial dimensions;

c. adjustable stops set to predetermine the length of traverse of said grinding wheel;

d. direction reversing means including microswitch means attached to the grinding wheel assembly whereupon said grinding wheel assembly is caused to change directional paths each time said microswitch means contacts said adjustable stops;

e. pawl and ratchet wheel means attached to the grinding wheel assembly causing said grinding wheel assembly to advance radially between 0.001 and 0.004 inches each time said pawl and ratchet means contact one of said adjustable stops;

f. means attached to the housing of said grinding means for preventing rotation of said reel during single blade grinding comprising a finger guide which is adjustable so that the relief angle between each reel blade and the grinding wheel can be preselected and which is further removable during spin grinding; and g. a spin grinding head attached to the shaft of said reel for spinning said reel in the same direction as the direction of the grinding wheel and which is characterized as being horizontally and vertically adjustable to accommodate lawn mower assemblies of varying sizes and which is capable of being disengaged from the shaft of said reel during single blade grinding.

2. The device of claim 1 wherein the tailstocks are mounted upon an adjustable bracket and wherein the engagement means are spring-loaded to secure the supporting structure.

* * * * *